US011396711B2

(12) United States Patent
Egli

(10) Patent No.: US 11,396,711 B2
(45) Date of Patent: Jul. 26, 2022

(54) ELECTROLYTIC NICKEL PLATING COMPOSITION AND METHOD OF ELECTROLYTIC NICKEL PLATING USING SUCH A COMPOSITION

(71) Applicant: RIAG Oberflächentechnik AG, Wängi (CH)

(72) Inventor: André Egli, Kriens (CH)

(73) Assignee: RIAG Oberflächentechnik AG, Wängi (CH)

( * ) Notice: Subject to any disclaimer, the term of this patent is extended or adjusted under 35 U.S.C. 154(b) by 14 days.

(21) Appl. No.: 16/822,216

(22) Filed: Mar. 18, 2020

(65) Prior Publication Data

US 2020/0299851 A1 Sep. 24, 2020

(30) Foreign Application Priority Data

Mar. 22, 2019 (DE) ..... 102019107416.9

(51) Int. Cl.
*C25D 3/12* (2006.01)

(52) U.S. Cl.
CPC ..... *C25D 3/12* (2013.01)

(58) Field of Classification Search
None
See application file for complete search history.

(56) References Cited

U.S. PATENT DOCUMENTS

| | | | | |
|---|---|---|---|---|
| 4,129,482 | A | 12/1978 | Lash | |
| 2013/0196174 | A1* | 8/2013 | Zhang-Beglinger ..... | C25D 3/32 428/647 |

FOREIGN PATENT DOCUMENTS

| | | | |
|---|---|---|---|
| DE | 865695 | B | 12/1952 |
| DE | 1217170 | B | 5/1966 |
| DE | 1223652 | B | 8/1966 |
| DE | 2054221 | B | 11/1973 |
| EP | 3431634 | A1 | 1/2019 |
| GB | 244167 | A | 12/1925 |
| GB | 892904 | A | 4/1962 |
| GN | 107829114 | A | 3/2018 |
| KR | 100971555 | B1 | 7/2010 |
| WO | 9818982 | A1 | 5/1998 |

OTHER PUBLICATIONS

Ding et al. (CN107829114A, machine translation). (Year: 2018).*
Kim et al. (KR 100971555, machine translation). (Year: 2010).*

* cited by examiner

*Primary Examiner* — Wojciech Haske
(74) *Attorney, Agent, or Firm* — Gardner, Linn, Burkhart & Ondersma LLP

(57) ABSTRACT

The invention relates to a composition for electrolytic nickel plating. In order to provide an improved composition, it is proposed that it comprises one or a plurality of nickel ion sources and a mono-, di- or tri-hydroxybenzene compound, preferably a hydroquinone compound or the salts thereof or mixtures thereof.

18 Claims, No Drawings

ELECTROLYTIC NICKEL PLATING COMPOSITION AND METHOD OF ELECTROLYTIC NICKEL PLATING USING SUCH A COMPOSITION

The invention relates to a composition according to the preamble of claim 1 and to a method for electrolytic nickel plating according to the preamble of claim 8.

Conventional nickel baths consist of a mixture of nickel sulfate, nickel chloride and Na-saccharin or Na-allyl sulfonate (so-called primary gloss carriers), secondary gloss carriers which generally have an alkyne group as functionality, as well as boric acid as a so-called conducting salt or buffer substance. The operative range of such nickel baths is in a pH range of 3.5 to 4.8.

On account of recurring concerns in relation to the mutagenic properties of boric acid at a corresponding high level of exposure and by virtue of the significant restriction due to legislation (cf. CLP Regulation 1272/2008/EC; SVHC candidate list pursuant to Article 57 or 59 REACh Regulation), boric acid-free compositions are being increasingly provided and used for the purpose of electrolytic nickel plating. However, in general these compositions have the disadvantage that the nickel layers deposited therefrom are less glossy and in particular are less smoothed.

GB 244,167 A discloses the use of a small quantity of hydroquinone as a reduction agent of iron which is present as an impurity of the anodes and results in pore formation in the nickel layer.

DE 865 695 B discloses the use of phenolic compounds as brighteners in nickel baths with high fluoride concentrations.

EP 3 431 634 A1 discloses a composition which as a buffer substance comprises 2-phenyl-5-benzimidazole sulfonic acid, salts thereof or mixtures thereof.

The object of the invention is to provide a composition for electrolytic nickel plating which permits properties of the nickel layer produced on the substrate, which are the same or better than those which can be achieved with a boric acid-containing composition. Moreover, the object of the invention is to provide a corresponding method for electrolytic nickel plating using such a composition.

This object is achieved by a composition having the features of claim 1 and by a method for electrolytic nickel plating having the features of claim 8. Dependent claims 2 to 7 and 9 describe advantageous embodiments of the invention.

In accordance with the invention, an improved composition for electrolytic nickel plating is provided by virtue of the fact that it comprises one or a plurality of nickel ion sources and a mono-, di- or tri-hydroxybenzene compound, preferably a hydroquinone compound or the salts thereof or mixtures thereof.

Very good nickel layers having comparable smoothness, a comparable gloss level and a comparable lack of pores are obtained herewith without boric acid.

Within the scope of this invention, a composition for electrolytic nickel plating means a nickel bath which is used for galvanic deposition of a nickel layer on a substrate, wherein the nickel ion source is nickel sulfate, nickel chloride and/or nickel sulfamate.

The mono-, di- or tri-hydroxybenzene compound preferably has a $pK_S$ value between 6.5 and 12.5.

A mono-hydroxybenzene compound can be e.g. phenolsulfonic acid, a di-hydroxybenzene compound can be e.g. catechol, resorcin or hydroquinone, a tri-hydroxybenzene compound can be e.g. pyrogallol, phloroglucin or hydroxyhydroquinone, but they are not limited thereto.

From the series of dihydroxybenzene compounds, hydroquinone (I) or the salts thereof are especially preferred.

(I)

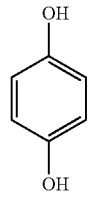

In a particularly advantageous manner, provision is made that the composition comprises an additional sulfoxylate ion source and/or an additional carboxylate ion source.

The additional sulfoxylate ion source or the additional carboxylate ion source is used as a weak complexing agent and serves, together with the mono-, di- or tri-hydroxybenzene compound, as a buffer substance. The sulfoxylate ion source or the carboxylate ion source likewise has a $pK_s$ value in the range of 6.5 to 12.5 and/or <3.

As a result, a pH value of the composition of 3 to 9 can be achieved. If sulfoxylate or carboxylate ion sources are used which have $pK_s$ values between 3 and 6.5, then they must not exceed a concentration of more than 1 g/L.

The composition in accordance with the invention permits, in conjunction with $Ni^{2+}$ ions, the formation of a new buffer range which is between the working range of the composition and the range in which nickel hydrolysis commences, i.e. predominantly in a pH range between 3 and 7, preferably 5 to 7.

It is assumed that—similarly to boric acid—the $Ni^{2+}$ ions do not become coordinatively saturated and therefore remain accessible for the acetylene-like gloss carriers. This accessibility is a prerequisite for the gloss carriers as electron-deficient compounds being able to demonstrate their π-back-bonding properties and thus being able to stabilise transition states of low oxidation stages of nickel, which results in the inhibition of electro-crystallisation and smoothness associated therewith.

The smoothing performance of the composition is comparable to that of boric acid. Moreover, the gloss level of the attainable nickel layer is comparable to that of boric acid.

A lack of pores in the produced nickel layers is most widely achieved with the composition in accordance with the invention. So-called burning-on in the high current density range by reason of hydrogen and nickel hydroxide formation is avoided.

The additional sulfoxylate ion source can be e.g. a sulfonic acid compound and the sulfoxylate ions (anions) can be e.g. sulfonates.

In a particularly advantageous manner, provision is made that the additional carboxylate ion source comprises a salicylic acid compound.

However, an additional carboxylate ion source can also be e.g. an acetic acid compound, formic acid compound, malic acid compound, tartaric acid compound, gluconic acid compound, benzoic acid compound, 3-sulfobenzoic acid compound, propionic acid compound or adipic acid compound, but is not limited thereto. Mixtures of the aforementioned acid compounds are also feasible.

The carboxylate ions (anions) of the present invention can be mono-, di-, tri- or tetra-carboxlyate ions, preferably of C1 to C30 carbon atoms, preferably mono- or di-carboxylate ions of C1 to C10 carbon atoms.

The carboxylate ions can be present e.g. as acetates, formates, malates, tartrates, gluconates, benzoates, 3-sulfobenzoates, propionates, adipates, salicylates or mixtures thereof. Other salts and/or esters are also feasible.

In a particularly advantageous manner, the salicylic acid compound is a 5-sulfosalicylic acid (II).

(II)

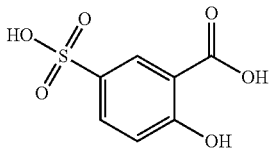

It is assumed that, in the case of pH values of 3 to 5, no reaction or only a very small reaction takes place between 5-sulfosalicylic acid ($pK_1$ 2.75, $pK_2$ 12.38) and $Ni^{2+}$ ions. The 5-sulfosalicylic acid prefers after deprotonation the formation of an intramolecular hydrogen bridge which is so strongly formed that complex formation with divalent nickel only becomes significant above a pH value of 5.5. This behaviour is practically identical to that between $Ni^{2+}$-ions and boric acid or borate.

Therefore, a composition which comprises hydroquinone and 5-sulfosalicylic acid is particularly advantageous.

In an advantageous manner, the mono-, di- or tri-hydroxybenzene compound, preferably the hydroquinone compound or the salts thereof or mixtures thereof, are present in quantities of 5-30 g/L, preferably 10-20 g/L, preferably 15 g/L.

In an advantageous manner, the additional sulfoxylate ion source and/or the additional carboxylate ion source, preferably the salicylic acid compound, preferably the 5-sulfosalicylic acid compound, or mixtures thereof are present in quantities of 5-40 g/L, preferably 5-25 g/L, preferably 10 g/L.

In accordance with the invention, the method for electrolytic nickel plating on a substrate comprises:

providing the substrate;

contacting the substrate with one of the aforementioned compositions; and applying an electric current to the composition and the substrate.

As a result, a nickel layer having the above-described properties is deposited on the substrate.

For this purpose, the strength of the applied electric current is preferably 0.5 to 4 A, preferably 1.5 to 3.5 A, preferably 3 A.

The following examples are used for the purpose of explaining the invention.

In order to evaluate the smoothing performance, commercially available brass sheets (Hull-cell sheets, Ossian) are coated by means of electrolytic nickel plating and then etched at the lower edge for 10 minutes with a 40° C. hot aqueous solution which contains sodium peroxodisulfate in a quantity of 200 g/L.

In order to produce the composition, 1000 ml of completely desalinated water is provided in a 2 L beaker (VWR) and brought to a temperature of 55° C. The following compounds are added with stirring:

Basic substances:

| | |
|---|---|
| nickel sulfate hexahydrate | 200 g/L |
| nickel chloride hexaydrate | 60 g/L |
| sodium saccharinate dihydrate | 3.2 g/L |
| sodium allyl sulfonate | 2.8 g/L |
| 1-(3-sulfopropyl)-pyridinum betaine 35% | 100 ppm |
| propargyl alcohol | 4 ppm |
| sodium lauryl sulfate | 1 g/L |

Additives in accordance with the invention:

EXAMPLE 1

| | |
|---|---|
| hydroquinone | 15 g/L |
| 5-sulfosalicylic acid | 10 g/L |

Completely desalinated water is introduced to the solution to make up 1500 ml.

The pH value is determined electrochemically by pH measuring chain on a pH-meter (Metrohm 744 pH-Meter). The device is calibrated with corresponding commercial solutions (CertiPUR Buffer Solution for the pH values 1, 4 and 7 by Merck) prior to the measurement. To measure current, a calibrated Fluke 175 True RMS Multimeter is used. The measured pH value is 5.

The anodes used are solid anodes consisting of solid nickel material (1 cm thick) with sheathings.

Commercially available brass sheets (Hull-cell sheets, Ossian) are coated with 3 A for 780 min at 55° C. after typical pre-treatment (degreasing, rinsing, activation, rinsing). A magnetic stir core operating at 100 revolutions per minute is used as the electrolyte movement.

After the coating procedure, the pH value of the electrolyte is likewise measured by means of the method described above. The measured pH value is 5.1.

Within the scope of examining the smoothing performance, a homogeneous, high-gloss layer was demonstrated from 0.05 $A/dm^2$ to the upper edge of the Hull-cell sheet, with smoothness at least as good as is the case in the comparative example with boric acid (45 g/L instead of hydroquinone and 5-sulfosalicylic acid).

The combination of hydroquinone and 5-sulfosalicylic acid thus has a highly inhibitory effect upon layer growth in the high current density range, wherein an extremely homogeneous layer thickness distribution is achieved without any hydrogen development being visible.

EXAMPLE 2

| | |
|---|---|
| 4-phenolsulfonic acid, Na-salt | 40 g/L |
| 5-sulfosalicylic acid | 5 g/L |

EXAMPLE 3

| | |
|---|---|
| 4-phenolsulfonic acid, Na-salt | 40 g/L |
| hydroquinone | 10 g/L |

EXAMPLE 4

| | |
|---|---|
| 4-phenolsulfonic acid, Na-salt | 40 g/L |
| hydroquinone sulfonic acid, K-salt | 10 g/L |

Examples 2 to 4 are conducted and evaluated in a similar manner to example 1. What is common to all of the examples is that they produce high-gloss, highly smooth and ductile layers.

Furthermore, even when 4-phenolsulfonic acid is used alone, it is possible to produce a corresponding layer which satisfies all of the requirements of a layer of a gloss nickel bath, with the exception of a low level of burning-on in the high current density range, which in practice is irrelevant for the most part. This limitation at high current densities can be very efficiently corrected with the addition of the secondary substances indicated in the examples, whereby the applicable current density range becomes considerably larger than in the case of corresponding boric acid methods, whilst all other aspects of a gloss nickel layer are retained.

It is assumed that this extension of the current density range is due significantly to the complexing properties of the additionally introduced, phenolic compounds which are effective specifically in the pH range of the nickel hydroxide formation.

The invention claimed is:

1. A composition for electrolytic nickel plating, the composition comprising one or a plurality of nickel ion sources in the form of nickel sulfate, nickel chloride and/or nickel sulfamate and a mono- or di-hydroxybenzene compound or the salts thereof or mixtures thereof as a complexing agent in a quantity greater than 5 g/L, wherein the composition includes 4-phenolsulfonic acid or a hydroquinone compound, catechol or resorcin as a mono- or di-hydroxybenzene compound, and further comprising an additional sulfoxylate ion source and/or an additional carboxylate ion source, and wherein the additional carboxylate ion source comprises a salicylic acid compound.

2. The composition as claimed in claim 1, wherein the salicylic acid compound is a 5-sulfosalicylic acid.

3. The composition as claimed in claim 1, wherein the mono- or di-hydroxybenzene compound or the salts thereof or mixtures thereof, and/or the hydroquinone compound, are present in a quantity of 5-30 g/L.

4. The composition as claimed in claim 3, wherein the mono- or di-hydroxybenzene compound or the salts thereof or mixtures thereof, and/or the hydroquinone compound, are present in a quantity of 10-20 g/L.

5. The composition as claimed in claim 4, wherein the mono- or di-hydroxybenzene compound or the salts thereof or mixtures thereof, and/or the hydroquinone compound, are present in a quantity of 15 g/L.

6. The composition as claimed in claim 1, wherein the additional sulfoxylate ion source and/or the additional carboxylate ion source or mixtures thereof are present in a quantity of 2-40 g/L.

7. The composition as claimed in claim 6, wherein the additional sulfoxylate ion source and/or the additional carboxylate ion source or mixtures thereof are present in a quantity of 5-25 g/L.

8. The composition as claimed in claim 7, wherein the additional sulfoxylate ion source and/or the additional carboxylate ion source or mixtures thereof are present in a quantity of 10 g/L.

9. The composition as claimed in claim 1, wherein the additional sulfoxylate ion source and/or the additional salicylic acid compound or mixtures thereof are present in a quantity of 2-40 g/L.

10. The composition as claimed in claim 9, wherein the additional sulfoxylate ion source and/or the additional salicylic acid compound or mixtures thereof are present in a quantity of 5-25 g/L.

11. The composition as claimed in claim 10, wherein the salicylic acid compound is a 5-sulfosalicylic acid.

12. The composition as claimed in claim 10, wherein the additional sulfoxylate ion source and/or the additional salicylic acid compound or mixtures thereof are present in a quantity of 10 g/L.

13. The composition as claimed in claim 12, wherein the salicylic acid compound is a 5-sulfosalicylic acid.

14. The composition as claimed in claim 1, wherein the composition has a pH value of 3 to 7.

15. The composition as claimed in claim 9, wherein the salicylic acid compound is a 5-sulfosalicylic acid.

16. A method for electrolytic nickel plating on a substrate, comprising:

providing the substrate;

contacting the substrate with a composition for electrolytic nickel plating as claimed in any one of claims 1 or 2 to 14; and applying an electric current to the composition for electrolytic nickel plating and the substrate.

17. The method as claimed in claim 16, wherein the strength of the applied electric current is 0.5 to 4 A.

18. The method as claimed in claim 17, wherein the strength of the applied current is 1.5 to 3.5 A.

* * * * *